US011284719B2

(12) United States Patent
Frank

(10) Patent No.: US 11,284,719 B2
(45) Date of Patent: Mar. 29, 2022

(54) DRAWER ASSEMBLY HAVING SECURABLE GUIDES AND RELATED METHODS

(71) Applicant: Greenheck Racing, Inc., Weston, WI (US)

(72) Inventor: Brandon R. Frank, Mosinee, WI (US)

(73) Assignee: Greenheck Racing, Inc., Weston, WI (US)

( * ) Notice: Subject to any disclaimer, the term of this patent is extended or adjusted under 35 U.S.C. 154(b) by 111 days.

(21) Appl. No.: 16/570,532

(22) Filed: Sep. 13, 2019

(65) Prior Publication Data

US 2021/0076821 A1 Mar. 18, 2021

(51) Int. Cl.

| | |
|---|---|
| ***A47B 88/90*** | (2017.01) |
| ***A47B 88/407*** | (2017.01) |
| ***A47B 88/427*** | (2017.01) |
| ***A47B 67/04*** | (2006.01) |

(52) U.S. Cl.

CPC ..... *A47B 88/941* (2017.01); *A47B 67/04* (2013.01); *A47B 88/407* (2017.01); *A47B 88/427* (2017.01); *A47B 2088/4276* (2017.01)

(58) Field of Classification Search

CPC ... A47B 88/941; A47B 88/407; A47B 88/427; A47B 88/57; A47B 88/423; A47B 88/43; A47B 67/04; A47B 2088/4276; A47B 2088/4235; A47B 2210/0059; A47B 2210/0064; A47B 2210/0067; A47B 2210/0072

USPC ..... 312/330.1, 334.46, 334.47

See application file for complete search history.

(56) References Cited

U.S. PATENT DOCUMENTS

| | | | | |
|---|---|---|---|---|
| 221,307 | A * | 11/1879 | Hirsch | |
| 668,078 | A * | 2/1901 | Baker | |
| 781,530 | A * | 1/1905 | Jespersen | |
| 879,690 | A * | 2/1908 | Starrett | |
| 1,184,978 | A * | 5/1916 | Meilink | 312/334.12 |
| 1,212,471 | A * | 1/1917 | Forbes | 312/334.8 |
| 2,730,423 | A * | 1/1956 | Mock | A47B 88/57 312/334.22 |

(Continued)

FOREIGN PATENT DOCUMENTS

| | | |
|---|---|---|
| EP | 0289256 A1 | 11/1988 |
| EP | 0664982 B1 | 9/2000 |

(Continued)

*Primary Examiner* — Daniel J Troy
*Assistant Examiner* — Timothy M Ayres
(74) *Attorney, Agent, or Firm* — Quarles & Brady LLP

(57) ABSTRACT

A drawer assembly has a frame with one or more drawer-receiving spaces and one or more drawers received therein. Each drawer includes a pair of guide-receiving tracks and a pair of securable guides. The pair of guide-receiving tracks are positioned on laterals sides of the drawer and each securable guide is received in one of the guide-receiving tracks. Each securable guide includes one or more bearing surfaces in engagement with the respective guide-receiving track to permit linear sliding translation of the drawer relative to the securable guide. Each securable guide also further includes a securing element having an installed position in which the securing element engages the lateral sides of the frame to attach and fix the securable guide in position relative to the frame. The securing element is movable away from this installed position to facilitate installation or removal of the drawer from the frame.

21 Claims, 12 Drawing Sheets

(56) References Cited

U.S. PATENT DOCUMENTS

| | | | | | |
|---|---|---|---|---|---|
| 2,731,321 | A * | 1/1956 | Thompson | A47B 88/57 | 312/334.46 |
| 4,065,196 | A | 12/1977 | Stein | | |
| 4,441,771 | A | 4/1984 | Roesler | | |
| 4,457,569 | A | 7/1984 | Scheerhorn | | |
| 4,759,341 | A * | 7/1988 | McFarland | F24C 15/168 | 126/339 |
| 4,872,734 | A * | 10/1989 | Rechberg | A47B 88/493 | 312/333 |
| 5,203,620 | A | 4/1993 | McLennan | | |
| 5,292,198 | A * | 3/1994 | Rock | A47B 88/43 | 312/333 |
| 6,851,286 | B2 * | 2/2005 | Dube | E05B 65/46 | 292/336.3 |
| 7,008,030 | B2 | 3/2006 | Yang | | |
| 7,111,913 | B2 * | 9/2006 | Dubon | A47B 88/49 | 312/333 |
| 7,571,968 | B2 | 8/2009 | Ji | | |
| 8,371,454 | B2 * | 2/2013 | Chen | H05K 7/1489 | 211/26 |
| 9,144,173 | B2 * | 9/2015 | Chen | H05K 7/1489 | |
| 9,326,603 | B2 * | 5/2016 | Iwamoto | A47B 88/40 | |
| 9,504,323 | B1 | 11/2016 | Porreca | | |
| 9,962,826 | B1 | 5/2018 | Surridge | | |

FOREIGN PATENT DOCUMENTS

| | | | |
|---|---|---|---|
| WO | 2013067286 | A1 | 5/2013 |
| WO | 2015173216 | A1 | 11/2015 |

* cited by examiner

DRAWER ASSEMBLY HAVING SECURABLE GUIDES AND RELATED METHODS

CROSS-REFERENCE TO RELATED APPLICATIONS

Not applicable.

FIELD OF INVENTION

This disclosure relates to drawer assemblies and, more specifically, to mechanisms for installing drawers into such assemblies and related drawer slide hardware.

BACKGROUND

Drawer assemblies with multiple slide-out drawers are often used to store tools and other equipment. Such drawer assemblies can be incorporated in a variety of structures including, but not limited to, tool boxes, cabinets, chests, workbenches, and so forth. Still further, such drawer assemblies may be part of stationary structures, on casters or other wheels for movement over short distances, or mounted to vehicles or trailers to provide mobilized drawer storage.

Regardless of the particular form and structure of the drawer assembly, such assemblies are often used in relatively rugged environments including as garages and workshops. They are thus subjected to harsh and rough working conditions based on the items they store and the context of their use.

SUMMARY

Given these usage conditions, many drawer assemblies are often of medium to heavy duty construction and are therefore made from metal to provide ample toughness and durability. As one example, many such metal drawers operate on heavy steel slides to open and close the drawers.

Such conventional drawer assemblies with heavy duty steel slides can be difficult and time consuming to construct. Still further, this type of construction can limit the versatility of the drawer configurations and the ability of the end user to customize or remove the drawers after the drawer assembly is manufactured.

Disclosed herein is an improved drawer assembly, a drawer for such a drawer assembly, and related methods of placing and moving such drawers in such a drawer assembly. Uniquely, the disclosed drawers include a pair of securable guides which are part of the drawer in which each of the securable guides have a securing element that can be used for selective affixation of the drawer to a frame or other drawer-receiving structure. While the securable guides serve as an affixing mechanism, they also are received in guide-receiving tracks in the drawer and provide bearing surfaces for the operation of the drawer when the drawer is slid in or out of the frame.

Such a novel and unique design offers many possible benefits. For one, drawers can be removed, installed, or reconfigured within a frame or other drawer-receiving structure with relative ease. The mode of installation and removal of drawers is comparably simplistic to other modes of drawer guidance assembly, which are time consuming and often require tools such as screw drivers, wrenches, and so forth to install. This design also accommodates for great flexibility in placement and re-configuration of drawers. For example, in a four-drawer space frame, four single-high drawers may be installed or, these drawers removed and two double-high drawers installed in four spaces, or one double-high drawer and two single-high drawers in various permutations within the four available single-high spaces.

Still further, in some forms, it is contemplated that the securable guides may not just be used for attachment to the frame and as a bearing surface for drawer guidance, but also as a structure for a turnable lock to engage with to lock or secure the drawer in the closed position to prevent it from sliding open as well as to prevent the drawer from being removed. These are but a few of the various possible benefits available from such a system and structure.

According to one aspect, a drawer assembly includes a frame having one or more drawer-receiving spaces therein which are positioned between lateral sides of the frame and one or more drawers in which each drawer is received in a respective one or more of the drawer-receiving spaces. Each drawer includes a pair of guide-receiving tracks and a pair of securable guides. The pair of guide-receiving tracks are positioned on a respective lateral side of the drawer and each securable guide is received in a respective guide-receiving track. Each securable guide includes one or more bearing surfaces in engagement with the respective guide-receiving track to permit linear sliding translation of the drawer relative to the securable guide. Each securable guide also further includes a securing element. The securing element has an installed position in which the securing element engages the lateral sides of the frame to attach and fix the securable guide in position relative to the frame (and thereby install the drawer within the frame). The securing element is movable away from the installed position for insertion or removal of the respective drawer from the frame.

In some forms, the securing element may be biased towards the installed position by a biasing force. The biasing force may be temporarily overcome to move the securing element away from the installed position during installation or removal of the drawer from the drawer-receiving space. In some instances, the act of inserting the drawer and respective securable guides into the frame may result in an interaction between the securing element and the frame that temporarily overcomes the biasing force to move the securing element away from the installed position before it then snaps back to the installed position to secure the securable guide relative to the frame.

In some forms, the securing element of the securable guide may be a latch which is pivotable laterally inward and outward relative to a body portion of the securable guide with the body portion of the securable guide providing the bearing surface(s). A pivotal axis of the latch may be perpendicular to a direction of linear sliding translation of the drawer relative to the securable guide. The latch may include a projection stop and the frame may include a fin such that, when the latch is pivoted outwardly, the projection stop engages the fin to fixedly secure the latch to the frame and, when the latch is pivoted inwardly, the latch is disengaged from the frame and the securable guide is separable from the frame.

In some forms, the drawer may further include a turnable lock on a front face of the drawer that is rotatable between a secured position and an unsecured position when the securable guides are in the installed position and the drawer is in a closed position relative to the frame. In the secured position, the turnable lock can engage the latch to secure the drawer in the closed position relative to the frame whereas, in the unsecured position, the turnable lock can disengage the latch to permit the drawer to be slid to an opened position relative to the frame. In one specific form, the latch may further include an inwardly-extending ridge on the distal end thereof relative to its pivotal axis and the turnable lock may include an engagement slot and, in the secured position, the engagement slot of the turnable lock can engage the inwardly-extending ridge on the distal end of the latch. In some forms, the turnable lock may have a rotational axis that is parallel to a direction of linear sliding translation of the drawer relative to the securable guide.

In some forms, the frame may include a pair of guide-receiving tracks on lateral sides of the frame. With such guide-receiving tracks being available, the drawer may further include a pair of fixed guides separate from the pair of securable guides. The fixed guides can be fixed relative to the drawer rearwardly of the securable guides and each the fixed guides can be in sliding engagement with a corresponding one guide-receiving tracks on lateral sides of the frame (meaning that these fixed guides are not fixed relative to the frame when the drawer is slid). Among other things, such fixed guides on the drawer can help provide further rearward support of the drawer. However, it is also contemplated that such rearward support provided by the fixed guides may not be completely necessary if the securable guide is of sufficient length to provide adequate support to the drawer and/or if the drawer and its contents are relatively light in weight (meaning less support may be needed).

In some forms, there can be more than one drawer-receiving spaces and at least one drawer may be removable from one of the drawer-receiving spaces and installable into another vacant drawer-receiving space(s) that is different from the space(s) from which it was removed.

In some forms, there can be more than one drawer. At least some of the drawers may be a different height than others. For example, at least some of the drawers may have a height that is an integer multiple of another one of the drawers such that the drawer can occupies multiple adjacent drawer-receiving spaces of the frame.

In some forms, when the securing elements of the pair of securable guides are moved away from the installed position, the respective drawer may be removable from its respective one or more drawer-receiving spaces by linear sliding translation alone without any tipping or rotating the drawer relative to the frame.

In some forms, when the securing elements of a drawer are in the installed position in which the securing elements engage the lateral sides of the frame to attach and fix the securable guides in position relative to the frame in one or more of the drawer-receiving spaces, the drawer can be openable and closeable relative to the frame.

According to another aspect, a method of placing drawers in a drawer assembly is disclosed. A drawer is inserted in a frame having one or more drawer-receiving spaces therein which are positioned between lateral sides of the frame. The drawer has a pair of guide-receiving tracks on respective lateral sides of the drawer and a pair of securable guides with each securable guide being received in a respective guide-receiving track. Each securable guide also includes one or more bearing surfaces in engagement with the respective guide-receiving track to permit linear sliding translation of the drawer relative to the securable guide. A securing element is moved on each of the respective securable guides to an installed position in which the securing element engages the lateral sides of the frame to attach and fix the securable guide in position relative to the frame and position the drawer in one or more of the drawer-receiving spaces.

In some forms, the securing element on each of the respective securable guides may be initially in the installed position prior to the insertion step and, during the insertion step, the securing elements may be temporarily moved away from the installed position before reassuming the installed position at the step of moving the securing element on each of the respective securable guides to the installed position.

In some forms, the method may further involve moving the securing element on each of the respective securable guides away from the installed position, removing the drawer from one or more drawer-receiving spaces in which the drawer was located, and inserting the drawer into another drawer-receiving space. In this way, a drawer initially installed in one drawer-receiving space can be moved to another.

In some forms, the drawer may further include a turnable lock on a front face of the drawer. With such a turnable lock present, the method may further include the step of, when the drawer is in a closed position within the frame, rotating the turnable lock to engage the turnable lock with the securing element on the corresponding securable guide. By such engagement, the drawer may be inhibited from being opened relative to the frame.

According to yet another aspect, a drawer is disclosed. The drawer includes a pair of guide-receiving tracks in which each guide-receiving track is positioned on a respective lateral side of the drawer and a pair of securable guides with each securable guide being received in a respective guide-receiving track. Each securable guide includes one or more bearing surfaces in engagement with the respective guide-receiving track to permit linear sliding translation of the drawer relative to the securable guide. Each securable guide further includes a securing element having an installed position to selectively secure the drawer by the pair of securable guides to a structure with one or more drawer-receiving spaces. The securable guide is also movable away from the installed position for insertion or removal of the respective securable guide of the drawer from the frame.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION

Figure 1:
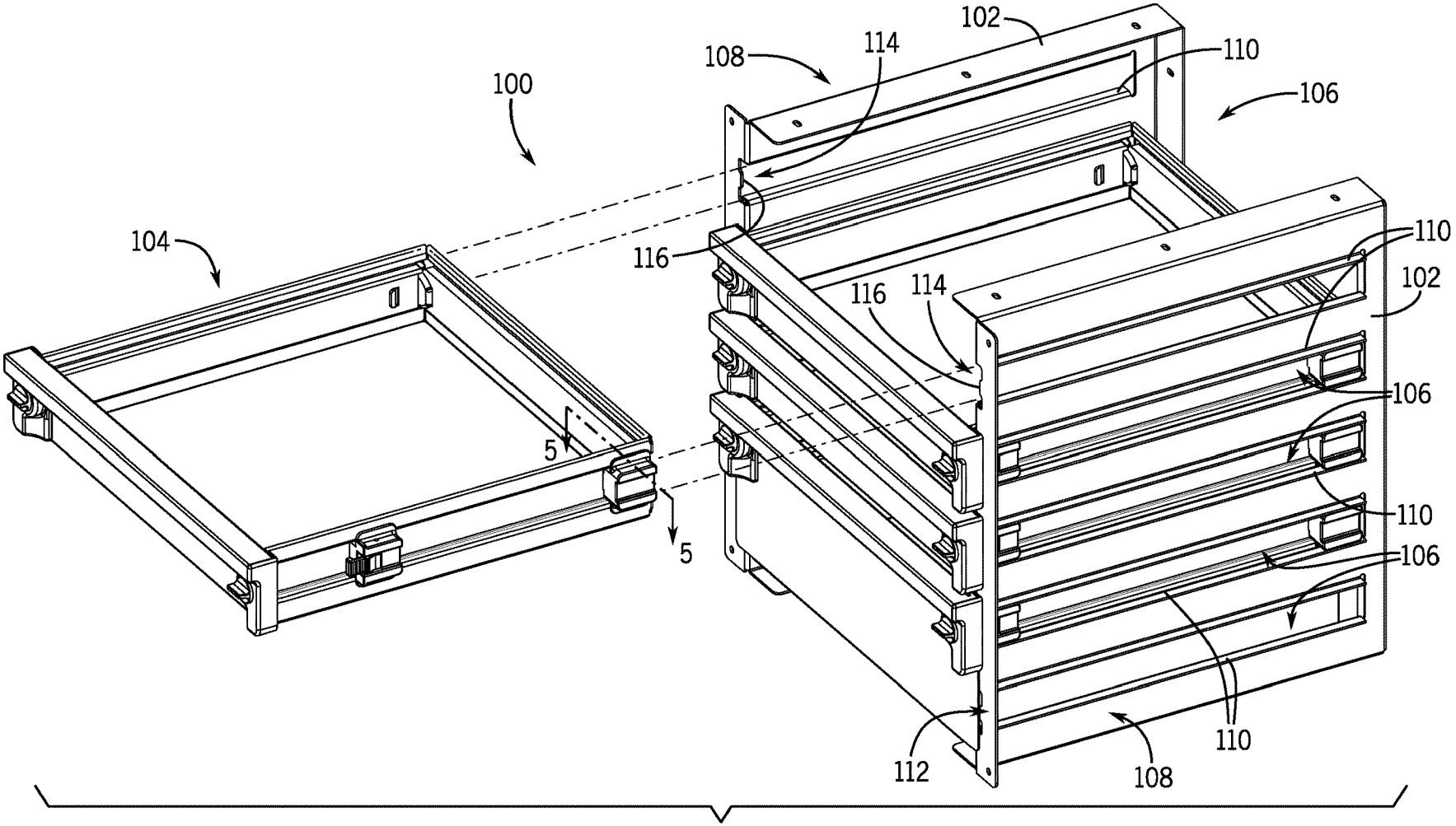
FIG. 1 is a perspective view of a drawer assembly with three drawers installed (two single-high and one double-high) into a frame with five drawer-receiving spaces and one drawer (single-high) not yet installed in the frame.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As used herein, unless otherwise specified or limited, "at least one of A, B, and C," and similar other phrases, are meant to indicate A, or B, or C, or any combination of A, B, and/or C. As such, this phrase, and similar other phrases can include single or multiple instances of A, B, and/or C, and, in the case that any of A, B, and/or C indicates a category of elements, single or multiple instances of any of the elements of the categories A, B, and/or C.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Referring first to FIG. 1, a drawer assembly 100 is illustrated which is but one possible configuration of a drawer assembly contemplated by this disclosure. Generally speaking, such a drawer assembly 100 includes two main components: a frame 102 and one or more drawers 104.

The frame 102 has one or more drawer-receiving spaces 106 which, in the case of the illustrated embodiment, includes five such drawer-receiving spaces 106. The frame 102 includes a pair of lateral sides 108 which include sets of guide-receiving tracks 110 with one of the pair on each of the opposing sides of each corresponding drawer-receiving space 106. Each of the pair include one such guide-receiving track 110 on each side of the opposing lateral sides 108 of the frame 102 that are at a corresponding height to one another. As will be described in greater detail below, these guide-receiving tracks 110 can receive one or more guides to support and guide the drawers 104 with respect to the frame 102.

At the forward end of the frame 102 and guide-receiving tracks 110 is a front side 112 of the frame 102. The front side 112 of the frame 102 includes space for the guides of the drawers to be received in the tracks 110 and also provides a mounting structure 114 for the securable guides (discussed in greater detail below) of the drawer 102 to be mounted. In the particular form illustrated, the mounting structure 114 is an inwardly extending fin 116 at the forward side of each of the drawer-receiving spaces 106. The engagement of the securable guides with this mounting structure 114 (or fin) will be described in greater detail below in FIGS. 8-11 after the structure of the securable guide has been described in greater detail.

At this point and before getting into further structural detail, a moment will be taken to appreciate some possible variations of the drawer assembly 100 at a general level.

First, while four drawers and five drawer-receiving spaces are in the illustrated embodiment, there may be any other number of drawers or drawer-receiving spaces. It is further contemplated that the number of drawers and drawer-receiving spaces can be equal to one another or may be different from one another. Because it is possible that drawers can potentially have a height that is greater than the height of the drawer-receiving space (for example, a drawer could be a multiple integer height of a standard height of the drawer-receiving space to occupy multiple adjacent drawer-receiving spaces) there can potentially be less drawers than drawer-receiving spaces. However, in some forms, there could also be a one-to-one correspondence between drawers and drawer receiving spaces.

From this it is apparent that it is also contemplated that all of the drawers could be, for example, a standard height or that some of the drawers could have heights different from the other drawers.

Still further, it is contemplated that there could be other variations across drawers such as, for example, the presence of internal divider systems in some of the drawers.

Beyond this, it will be appreciated that the specific frame illustrated is representative. It is contemplated that the frame could be a single part or multiple parts whether assembled together or affixed to other surrounding structure. In this regard, it is contemplated the frame could be provided by another larger object such as a movable cabinet, chest, chassis or so forth.

Still further, while guide-receiving tracks are illustrated on the frame, it is contemplated that in some forms, guide receiving tracks may not be present as part of the frame. From the description that follows, it will become apparent that the securable guides are attachable to locations on frame, but that once such attachment of the securable guides is completed, the drawer guidance may be achieved by interaction between the securable guides and tracks on the drawer.

Finally, because of the nature and use of the drawer assembly, it is contemplated that many or all of the components can be constructed from metal such as aluminum or aluminum alloys, for example. However, it is contemplated that similarly structured and described drawer assemblies could be made from other materials such as polymeric materials.

Figure 2:
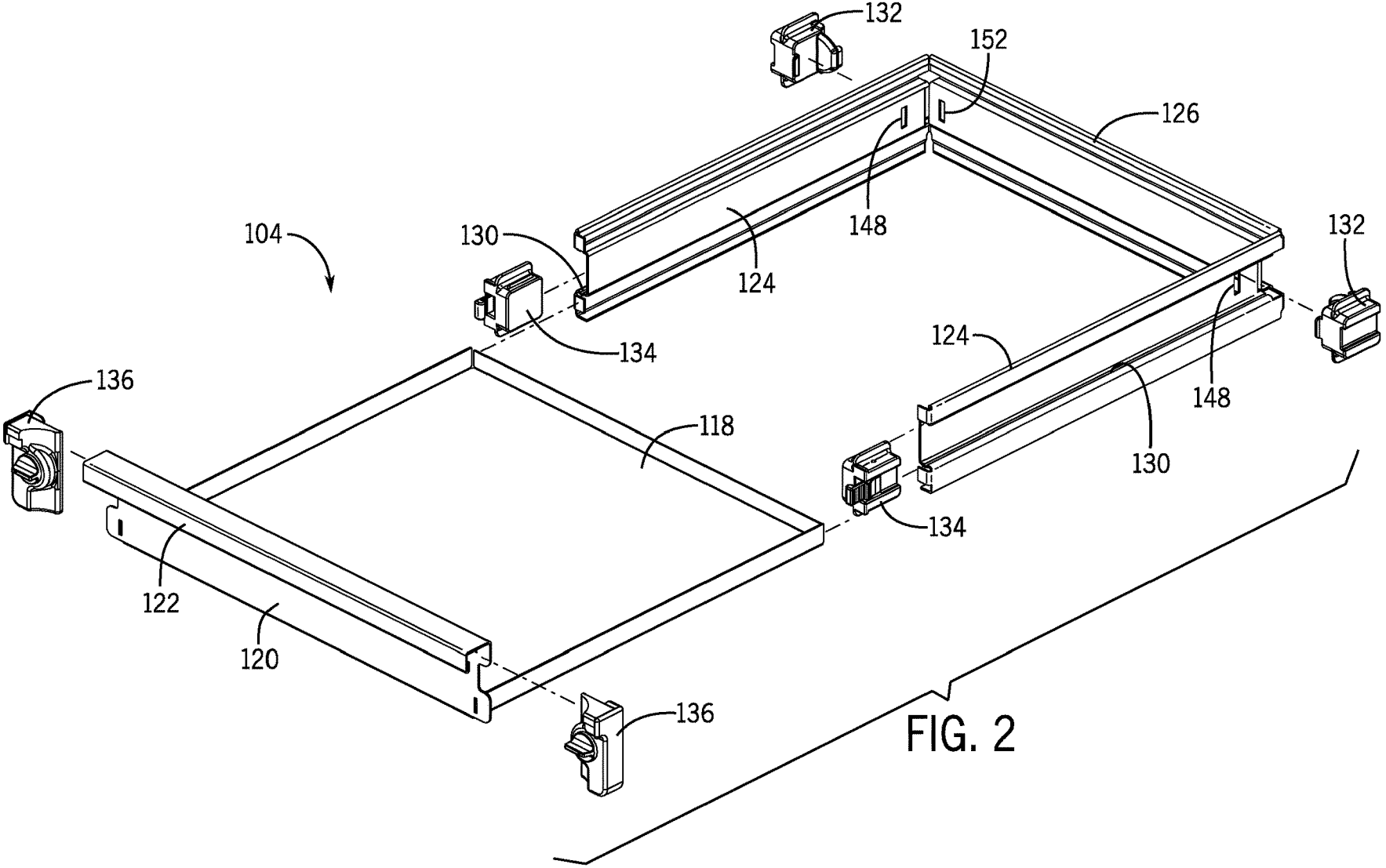
FIG. 2 is an exploded perspective view illustrating the construction of an exemplary drawer from FIG. 1.

Looking now at FIG. 2, the general construction of one exemplary drawer 104 from the drawer assembly 100 is illustrated to show the various constituent parts. In the form illustrated, the drawer 104 includes a base wall 118 having a front face 120 attached thereto with a forwardly-position drawer pull 122. A pair of lateral side walls 124 and a rear side wall 126 are placed around the base wall 118 and affixed thereto. Each of the lateral side walls 124 include a guide-receiving track 130 that extends front to back and that each receives a fixed guide 132 at the rear end thereof and a securable guide 134 therein. Furthermore, in the form illustrated, the drawer 104 includes a pair of turnable locks 136 attached to the lateral sides of the front face 120 of the drawer 104. When assembled together, these parts form a drawer 104 having an appearance similar to the drawer 104 illustrated in FIG. 1 in which the drawer 104 is generally rectangular with upwardly-facing internal space for reception of times.

Figure 3:
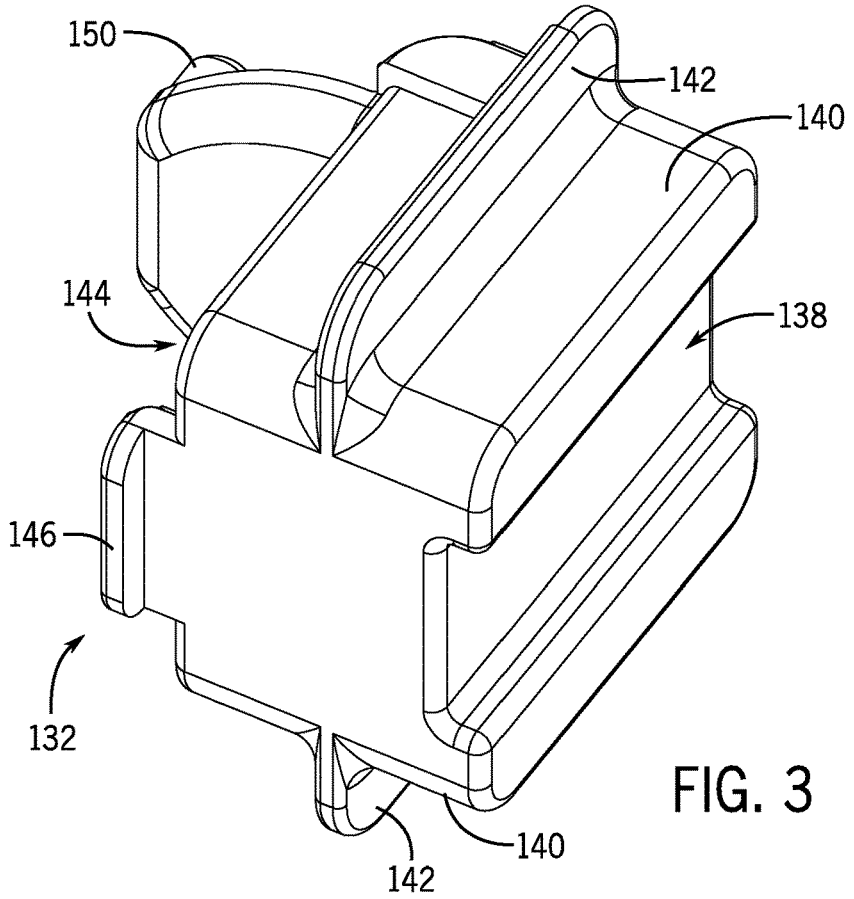
FIGS. 3 and 4 are perspective views of one of the fixed guides from FIGS. 1 and 2 showing, respectively, the front, top, and outward lateral sides in FIG. 3 and the rear, bottom, and inward lateral sides in FIG. 4.
Figure 4:
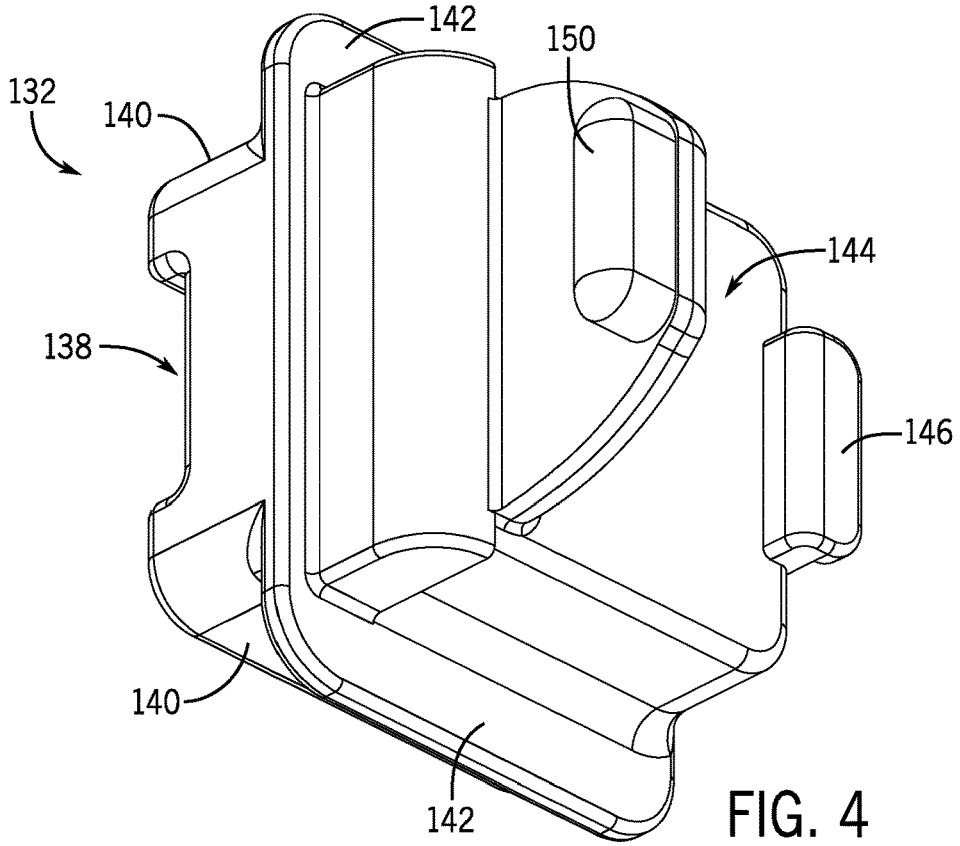

Turning now to FIGS. 3 and 4, one of the fixed guides 132 is illustrated in greater detail. Such a fixed guide 132 can serve multiple purposes including serving as a traditional bearing or guidance surface for the drawer 104 as well as, in some cases, providing a way for the side walls to be attached to one another. Because of the use of the fixed guides 132 it is contemplated that, while the fixed guides 132 could be made of various materials, some materials (e.g. plastics) may be more suitable than others to provide a smooth gliding surface.

With respect to serving as a bearing or guidance element, it can be seen that fixed guide 132 has a generally laterally outward side 138 which provides a pair of bearing surfaces 140 for reception in the guide-receiving track 110 of the frame 102. These bearing surfaces 140 are generally planar and spaced apart from one another with one of the pair of bearing surfaces 140 facing upwards and the other facing downwards. This specific structure of the bearing surfaces 140 is a function of the corresponding structure of the guide-receiving track 110 so that they can mate together. It is of course contemplated that the track 110 and bearing surfaces 140 could be varied and that there need not be a top and a bottom bearing surface in all instances.

Still further, it can be seen from FIGS. 3 and 4 that the fixed guide 132 has vertically-extending flanges 142 which may also serve as bearing surfaces and a separator between the lateral walls of the frame 102 and the lateral side walls of the drawer 104.

Figure 5:
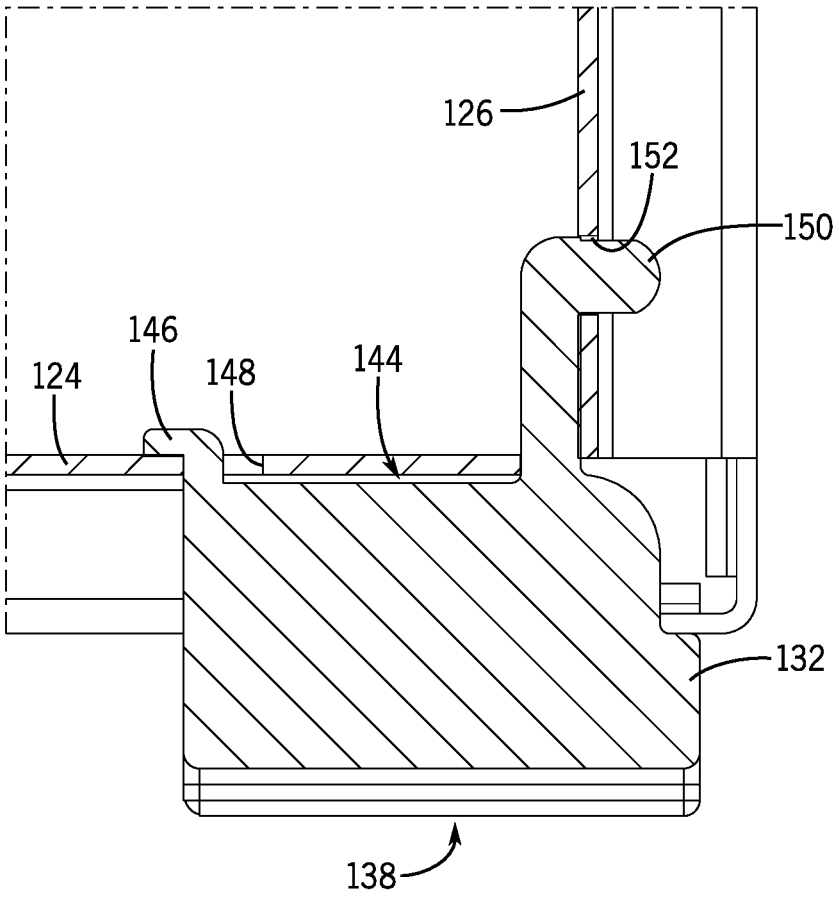
FIG. 5 is a cross-sectional top view taken through line 5-5 in FIG. 1 illustrating the use of the fixed guide to secure walls of the exemplary drawer together.

With respect to providing a way for the side walls to be attached to one another and with additional reference being made to FIG. 5, the fixed guide 132 can also include a laterally inward side 144 with a lateral projection 146 that engages a slot 148 in the lateral side wall 124 of the drawer and rear projection 150 that engages a slot 152 in the rear side wall 126. With these projections 146 and 150 and as illustrated in FIG. 5, the fixed guides 132 can be located at the rear corners and used to snap, lock, or otherwise secure one of the lateral side walls 124 to the rear side wall 126 as part of the general construction of the drawer.

As noted above, the fixed guides 132 are not strictly required in this design, but when present could serve one or both of these guidance and drawer construction functions. It is to be appreciated that with other side wall designs (for example, if the rear side wall and lateral side walls are formed of a single U-shaped piece) such a connecting joint may not be present and the fixed guides 132, if present, may not serve this function. Still further, there could also be a separate connection mechanism apart from the fixed guides 132 at these locations, even if the fixed guides 132 are present for bearing purposes.

Figure 6:
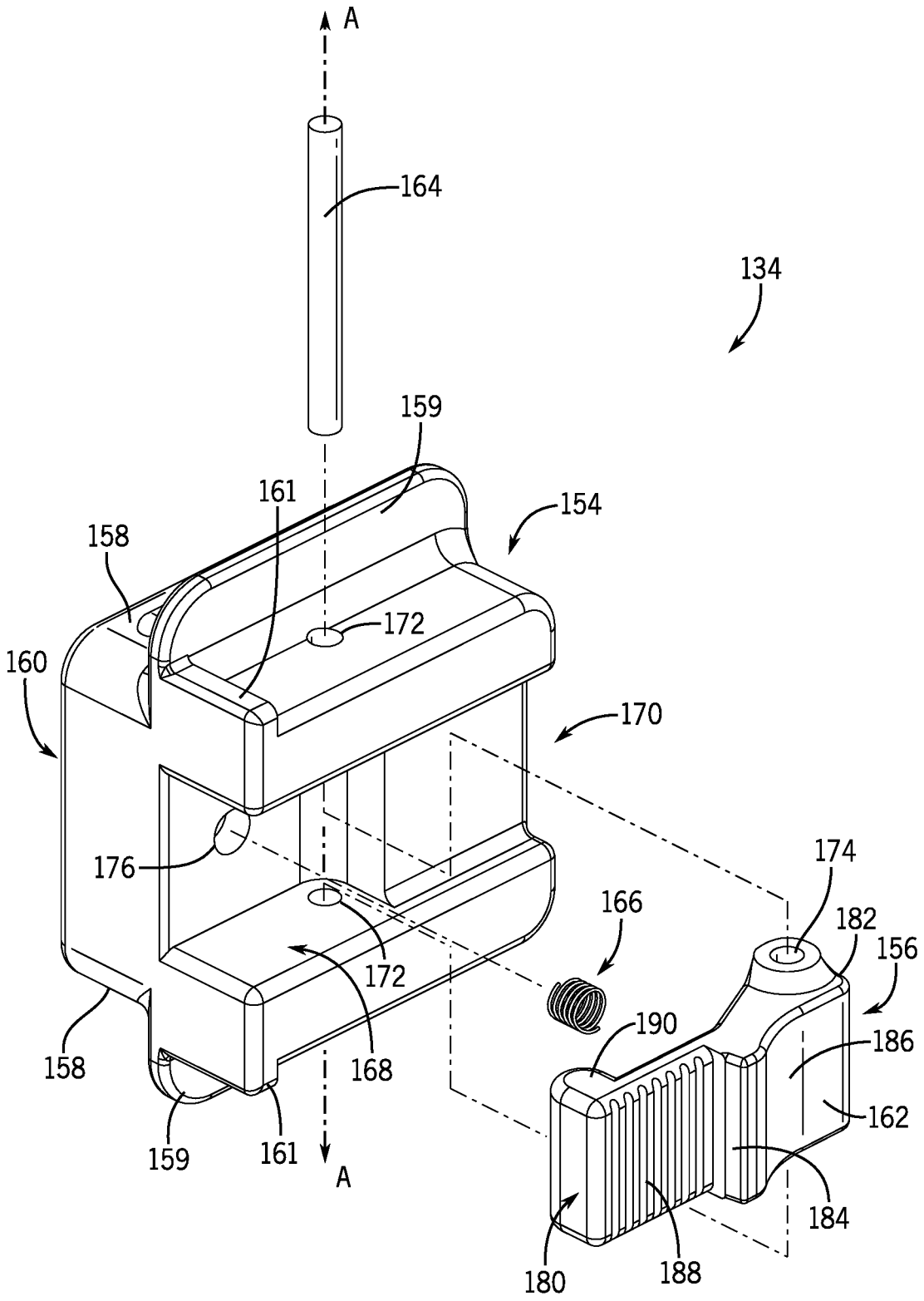
FIG. 6 is an exploded perspective view of one of the pair of securable guides from the exemplary drawer of FIGS. 1 and 2 illustrating the body portion with the bearing surfaces, the securing element in the form of a latch, its pivot pin, and its biasing element in the form of a spring.
Figure 8:
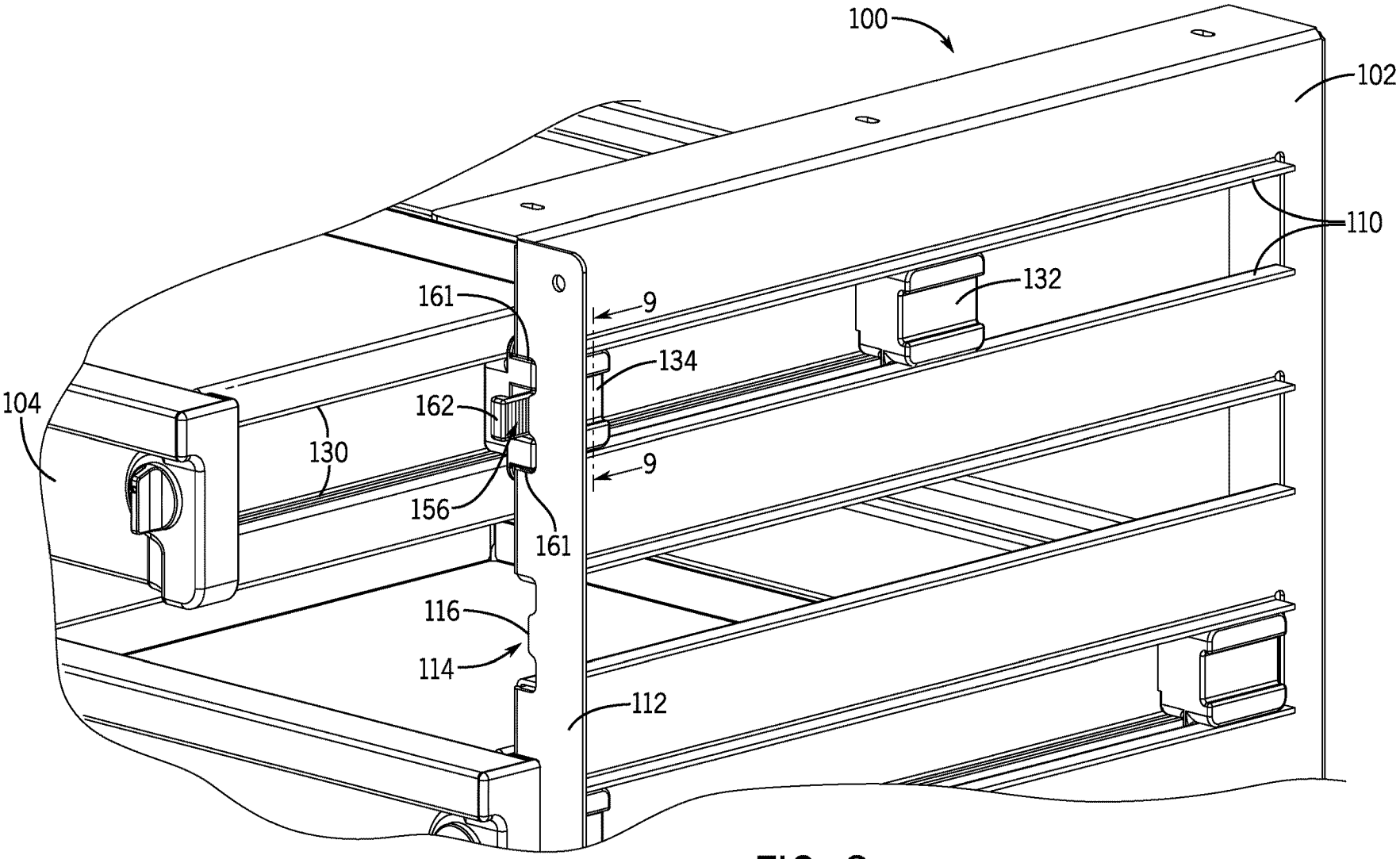
FIG. 8 is a perspective view of the exemplary drawer after being received and installed in the frame of the drawer assembly of FIG. 1 and in which the securing element of the securable guide has been biased outwardly to the installed position to secure the securable guide and, hence, the drawer in the frame.

Turning now to FIG. 6, one of the pair of securable guides 134 is illustrated in exploded form. As illustrated, each securable guide 134 includes a body 154 providing bearing and guidance functions for the drawer 104 and a securing element 156 that is pivotable with respect to body 154 (and in the form illustrated, has a distal end that is biased laterally outwards) and can be used to mount the securable guide 134 to the frame 102 at a respective mounting structure 114 as is illustrated in FIGS. 8 and 9 (which point to an adjacent mounting structure to that which the securable guide 134 is secured for purposes of better identifying a comparable mounting structure with reference numerals).

Figure 7:
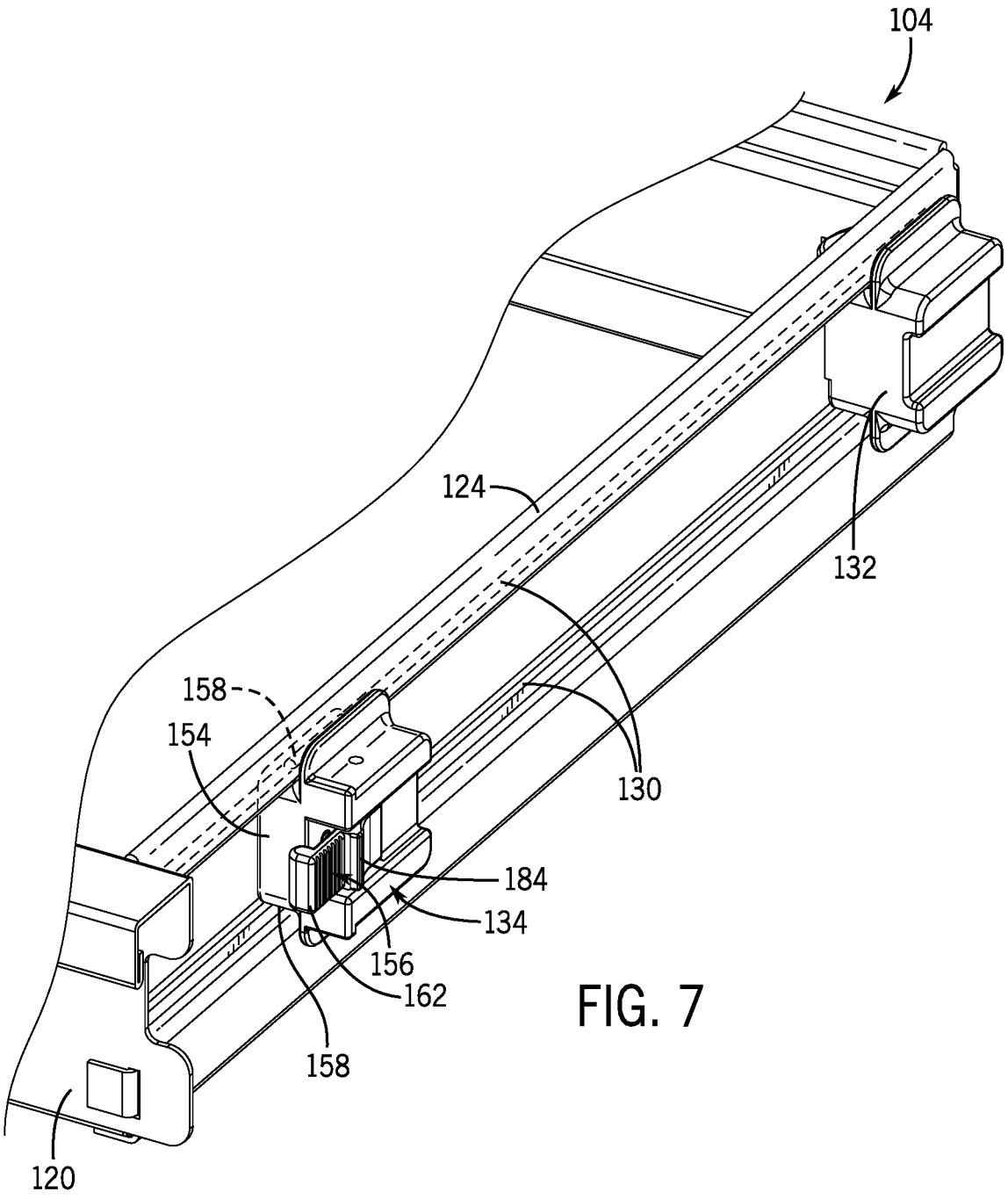
FIG. 7 is a detailed view of one of the guide-receiving tracks on one of the lateral sides of the exemplary drawer in FIGS. 1 and 2 having a fixed guide from FIGS. 3 and 4 on a rear end thereof and the securable guide from FIG. 6 therein.

Looking first at the body 154 in FIG. 6, the body 154 includes a pair of bearing surfaces 158 on the laterally inward facing side 160 of the securable guide 134. These bearing surfaces 158 are generally upward or downward facing. Each of the bearing surfaces 158 are received in one of the guide-receiving tracks 130 of the lateral side wall 124 of the drawer 104 as is generally depicted in FIGS. 7 and 9. Within the guide-receiving track 130, the securable guide 134 is then linearly translatable forward and backward relative to the drawer 104 between the fixed guide 132 and the front face 120 of the drawer 104.

Figure 9:
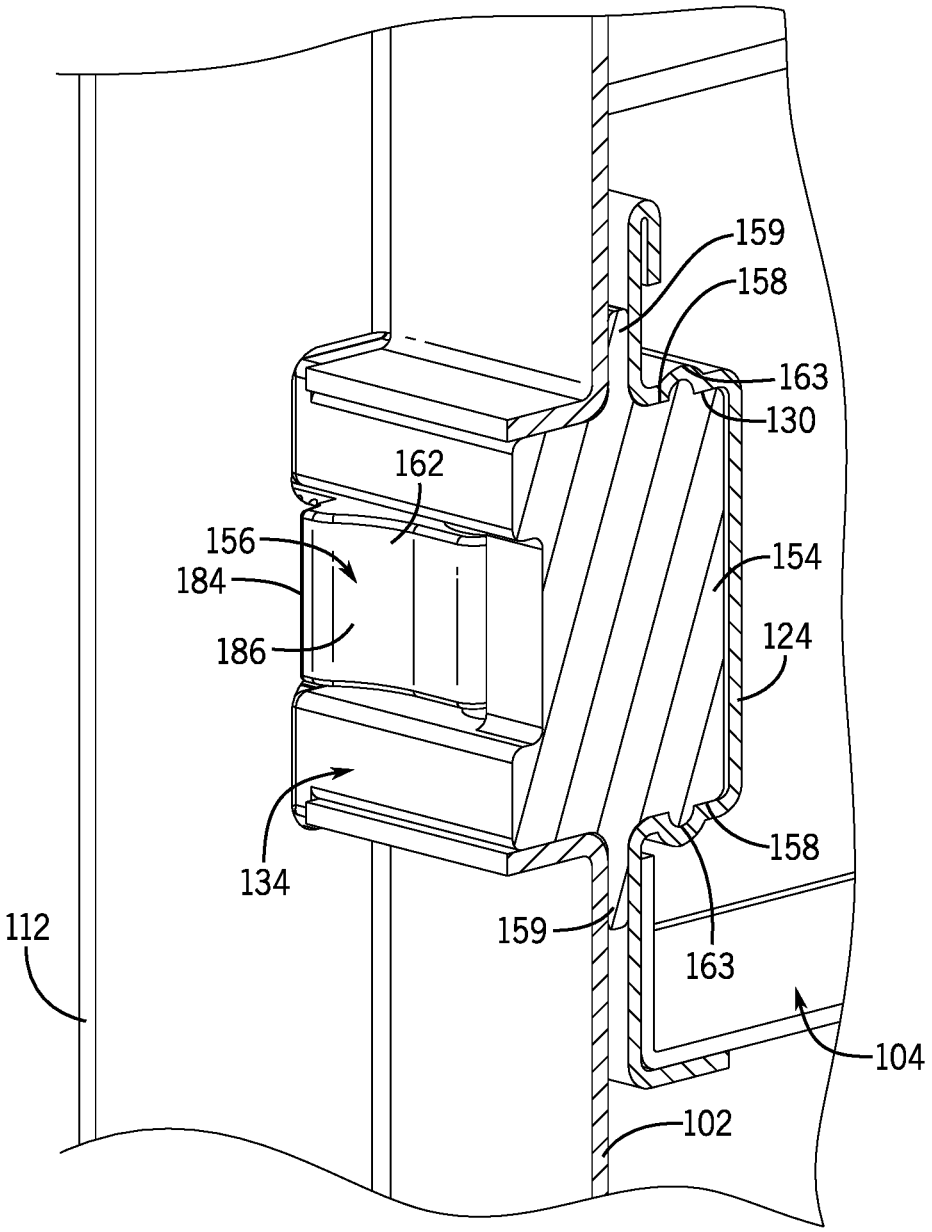
FIG. 9 is a cross-sectional side view taken through line 9-9 of FIG. 8 illustrating how the securable glide bears on the guide-receiving track and further illustrating how the projection stop of the securing element engages a backside of a vertical support on the frame in the installed position to fix the securable guide with respect to the frame.

Further and as is best seen in FIG. 9, the bearing surfaces 158 of the body 154 of the securable guide 134 and the guide-receiving tracks 130 can have a shaped profile 163 including, for example, a semi-arcuate bump. This profile extends forward to back along the guide-receiving track 130 and helps to retain the securable guide 134 within the respective guide-receiving track 130 of the drawer 104 so that it does not fall out laterally. While a "bumped" profile is illustrated, it should be appreciated that this is but one example and other profiles could be used to similar effect.

For example, a slight undercut or taper on the securable guide 134 and the tracks 130 could also prevent the securable guide 134 from laterally falling out of the track 130 after the two are assembled together.

Returning now to FIG. 6, the body 154 further includes vertically-extending flanges 159 which may also serve as bearing surfaces and a separator between the lateral walls of the frame 102 and the lateral side walls of the drawer 104 (see, in particular, the placement of the flanges 159 in the cross-sectional view of FIG. 9). As will be apparent from the description that follows, the securable guide 134 and its body 154 will be affixed to the frame 102 and so, after installation thereto, the only motion between the flanges 159 and adjacent structure will be between the flanges 159 and the drawer 104 when the drawer 104 is opened or closed.

Further still and as best seen in FIG. 6, the body 154 includes forward mounting flanges 161 at a forward end of the securable guide 134. During the mounting procedure discussed below, the mounting structure 114 and its fin 116 is captured between this mounting flange 161 and a projection stop 184 on a latch 162 to mount the securable guide 134 to the frame 102.

Looking now more closely at the securing element 156 portion of the securable guide 134, the securing element 156 is a small subassembly connected to the body 154. This subassembly includes the aforementioned latch 162, a pivot pin 164 that establishes a rotational or pivotal axis A-A for the latch 162, and a biasing element 166 that provides a biasing force (as illustrated in the form of a spring). As shown in FIG. 6, the subassembly is largely received in a recess 168 on the laterally outward facing side 170 of the body 154. The latch 162 is maintained in this recess 168 by the presence of the pivot pin 164 which may be press fit into openings 172 in the body 154 or an opening 174 of the latch 162 (which openings 172 and 174 are both coaxial with the pivotal axis A-A, which axis is also generally perpendicular to the direction of extension the bearing surfaces 158 and the corresponding guide-receiving tracks 130 of the lateral side wall 124 of the drawer 104). With additional reference being made to FIGS. 10 and 11, the biasing element 166 is interposed between a laterally outward facing base wall of the recess 168 and a laterally inward facing wall of the latch 162 and received in respective blind holes 176 and 178 of each to maintain the biasing element 166 in place between the body 154 and the latch 162.

In the form illustrated, the biasing element 166 is a spring which is in compression and generally causes a distal end 180 of the latch 162 to pivot laterally outward about the axis A-A. Put differently, and with reference being made to FIGS. 10 and 11, the biasing element 166 generally forces the latch 162 to the installed position of FIG. 10, but when the biasing force of the spring is overcome permits the latch 162 to be temporarily rotated inward or moved away from the installed position as illustrated in FIG. 11.

Notably, the latch 162 can also include a few other surface features which may be pertinent to operation of the securable guide 134.

On the end of the latch 162 proximate the pivot pin 164, there is a rotational stop 182. This rotational stop 182 contacts a wall of the recess 168 in the installed position to prevent further rotation of the latch 162 relative to the body 154, thereby limiting the range of motion of the latch 162 in that rotational direction and also keeping the biasing element 166 loaded in all positions of the latch 162 such that the biasing element 166 is constantly providing a biasing force.

Another surface features is a projection stop 184 that is on the latch 162 on the laterally outward side of the latch 162 part way between the pivotal axis A-A and the distal end 180 of the latch. This projection stop 184 provides a stop surface which can be used, in part, to secure, attach or fix the securable guide 134 to the frame 102 as will be described in greater detail momentarily.

Between the pivotal axis A-A of the latch 162 and the projection stop 184 is an outward engagement surface 186. This outward engagement surface 186 can be shaped and positioned to engage part of the mounting structure 114 of the frame 102 to effectuate the temporary movement of the securing element 156/latch 162 away from the installed position as the securing element passes from forward of the front side 112 of the frame 102 to a point beyond the front side 112. For example, the fins 116 of the mounting stricter 114 of the frame 102 can contact these engagement surfaces 186 during the insertion of the drawer 104 into the drawer-receiving space 106 to automatically push the securing elements 156 on the securable guides 134 temporarily away from the installed position.

The latch 162 can also include a set of ridges or other texturing 188 on one laterally outward facing surface thereof between the projection stop 184 and the distal end 180 of the latch 162. This texturing 188 helps provide a surface with good frictional or engagement properties if a user presses the latch 162 in this region to temporarily overcome the biasing force to move the securing element 156/latch 162 away from the installed position.

Additionally, the latch 162 can include an inwardly-extending ridge 190 on the distal end 180. As will be described below, this inwardly-extending ridge 190 can engage the turnable lock 136 in some designs to secure the front face 120 of the drawer 104 to the securable guide 134.

Figure 10:
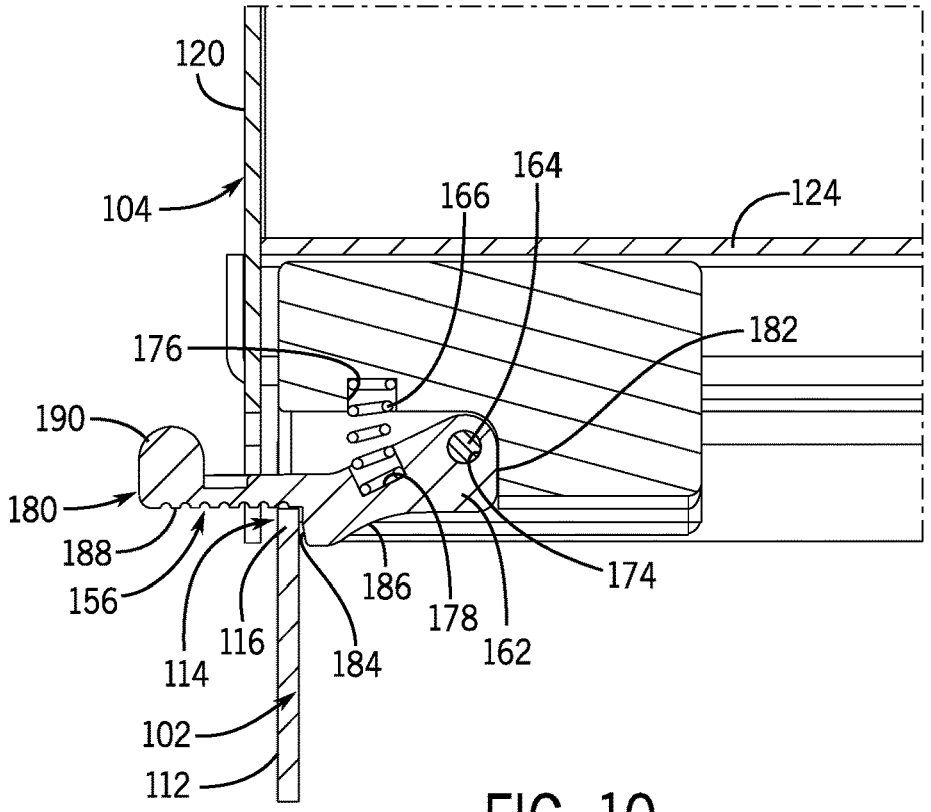
FIGS. 10 and 11 are a top-down cross-sectional views taken through the securable guide with the securing element or latch in the installed position to secure the securable guide and thereby the drawer in the frame as shown in FIG. 10 and moved away from the installed position by overcoming the biasing force to permit the securable guide (and thereby the attached drawer) to be moved in to or out of the frame as shown in FIG. 11.
Figure 11:
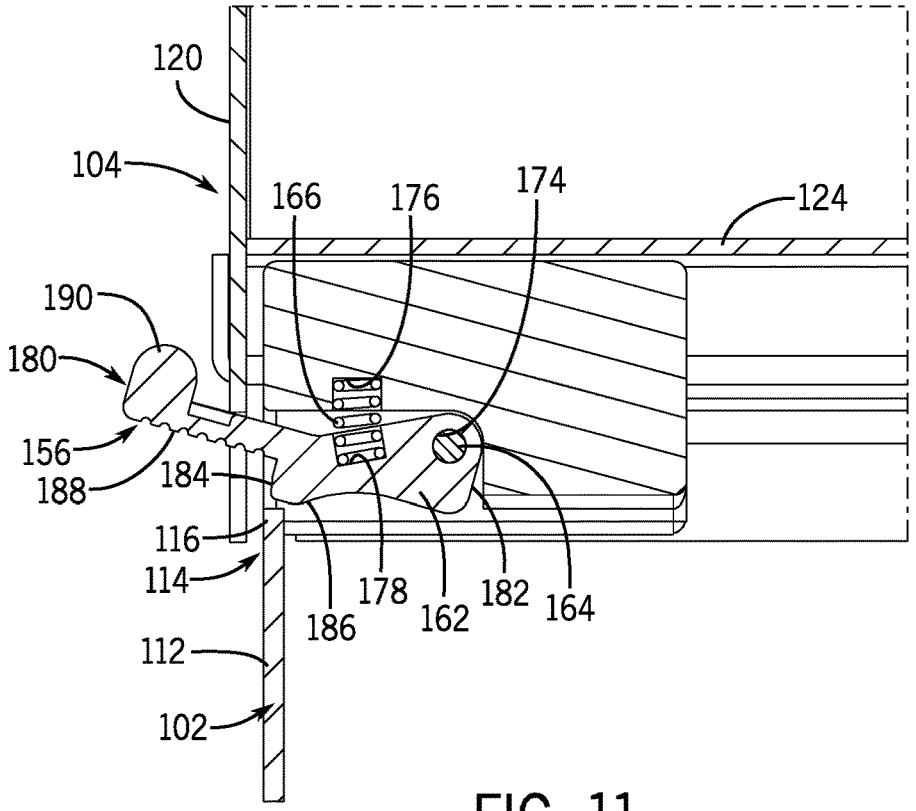

With the various parts of the securable guides 134 having been described, the manner of fixation of one of the securable guides 134 in the frame 102 of the drawer assembly 100 is shown in FIGS. 8-11 in which the securing elements 156/latches 162 are shown in the installed position and secured within the frame 102 in FIGS. 8-10 and is shown moved away from the installed position in FIG. 11.

Initially, when the drawer 104 is outside of the frame 102 entirely, the securable guides 134 are in the "installed" position in which they are biased laterally outwardly even though the drawer 104 is not yet installed in the frame 102. When the drawer 104 is inserted into one or more of the drawer-receiving spaces 106 the frame 102, the drawer 104 is initially received in the drawer-receiving space 106, rear side first, with the fixed guides 132 (if they are present) being received in the corresponding guide-receiving tracks 110 of the frame 102 until the securable guides 134 approach the mounting structure 114. At this point in the insertion, the outward engagement surfaces 186 of the securing elements 156/latches 162 engage the corresponding fins 116 of the mounting structure 114 on the front face 112 of the frame 102. Then, as the insertion of the drawer 104 continues, this engagement causes the securing elements 156/latches 162 to temporarily move away from the installation position and go laterally inward against the biasing force until the projection stop 184 of the securable guide 134 passes the fin 116. At this point, the securing elements 156/latches 162 snap back to the installed position as illustrated in FIG. 10. In this position, the mounting flange 161 of the body 154 has also approached and/or contacted the front face 112 of the frame 102 and prevents the further and over insertion of the securable guides 134 relative to the frame 102. Accordingly in this position, the securable guides 134 are captured in place with respect to the frame 102 and the drawer 104 is potentially moveable into and out of the frame 102 of the drawer assembly 100 as an installed drawer typically is by linear translation and without the ability to simply side the drawer 104 entirely.

While a specific process for installation was described above, variations may be present. For example, rather than deflecting the securing elements 156/latches 162 by virtue of contact between the fins 116/mounting structure 114 of the frame 102 during the insertion process, these securing elements 156/latches 162 may be manually pressed in by the individual installing the drawer 104. Still further, it should be appreciated that while securing elements 156 have been illustrated which biased towards an installation position, the securable guides 156 may have an alternative structure lacking such biasing, but the securable guides 156 may have a toggleable securing element which the user may manually toggle, for example, between an installed and uninstalled position.

In the particular form illustrated and with the drawer 104 installed in the frame 102, the drawer 104 is only separable by the frame 102 by a user temporarily pressing the securing elements 156/latches 162 laterally inwards to move it away from the installed position as illustrated in FIG. 11. With the securing elements 156/latches 162 moved away from the installed position, the projection stops 184 can be withdrawn past the fins 116 or the mounting structure 114 of the frame 102 generally, and the securable guides 134 separated from frame 102 such that the drawer 104 is removable forwardly therefrom.

Thus, in this way, a drawer which is initially apart from a frame can be installed in the frame securely. The securable guides not only secure the drawer to the frame but also supply a part of the guidance system of the drawer assembly once installed. Subsequently and without the use of specialized tools, the installed drawer can be also be removed by simply pushing the securing elements or latches of the securable guides in from the exterior side of the frame and the securable guides can be released and withdrawn so the drawer can be pulled out of the frame entirely. In so doing, it is possible to have drawers which are switchable with one another, able to be reconfigured in position within the frame, or replaced altogether.

Figure 12:
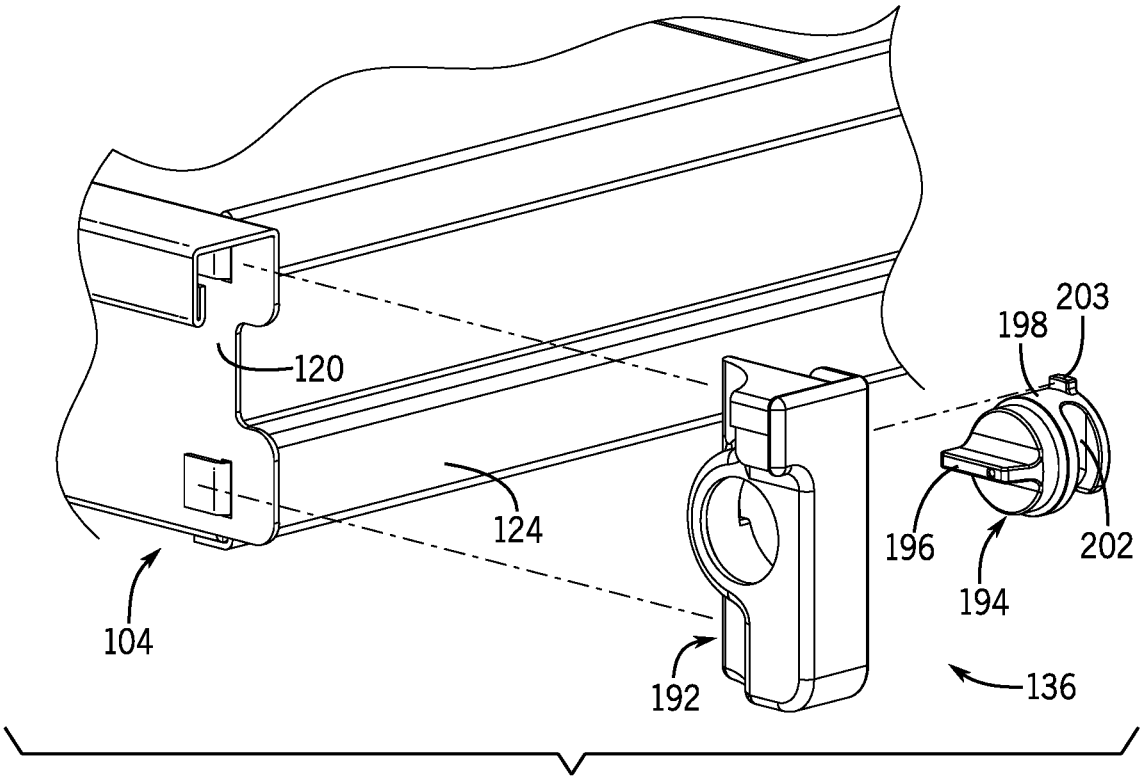
FIG. 12 is a partial exploded perspective view illustrating a turnable lock exploded from a front face of an exemplary drawer in which the parts of the turnable lock, including the support body and the turnable element, are separately shown.

Now, with reference being made to FIGS. 12-15, the drawer 104 can also be designed to have turnable locks 136 which help retain the as-installed drawer in a closed position and prevent the drawer 104 from being opened relative to the frame 102. Looking at FIGS. 12-15, the structure of this turnable lock 136 is illustrated. The turnable lock 136 can be of a simple two-part construction in which there is a support body 192 and a turnable element 194 as depicted in FIG. 12.

Figure 14:
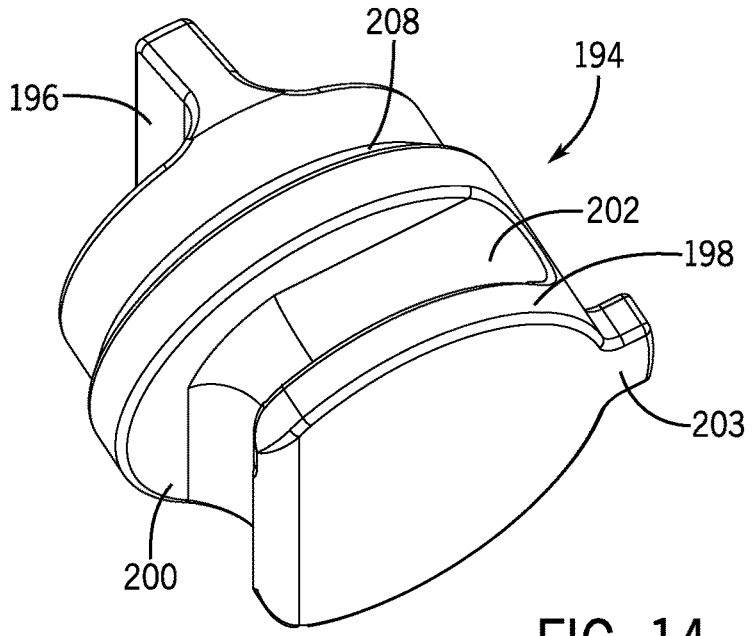
FIG. 14 is a perspective view of the rear side of the turnable element showing a clearance cutout, an engagement slot, and a limiter tab.

As can be seen in FIGS. 12 and 14, the turnable element 194 has a forwardly facing knob 196 which is attached to a rearwardly positioned base 198. The base 198 is disc-like includes a clearance cutout 200 and a slot 202 around its circumference. A radially extending stop tab 203 extends outwardly from the base 198 as well and can be used to limit the range of rotation motion of the turnable element 194 within the support body 192.

Figure 13:
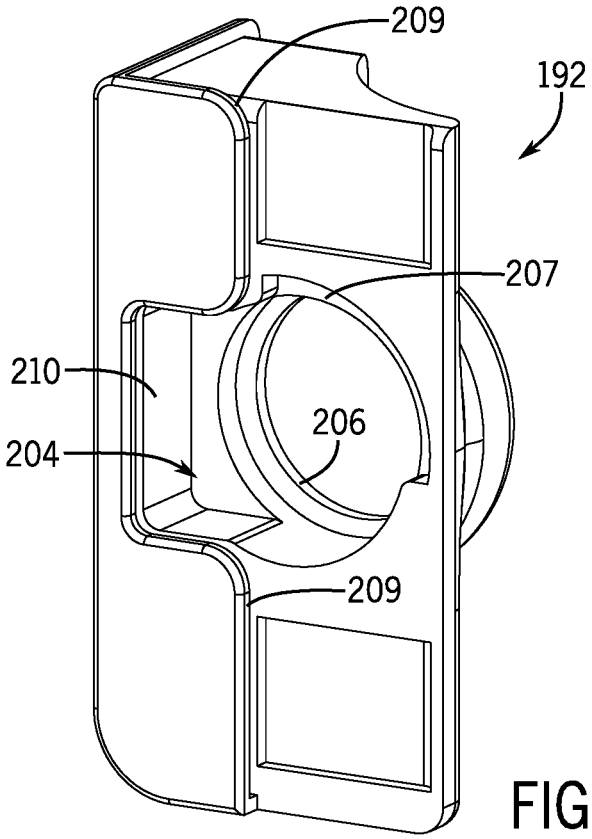
FIG. 13 is a rear side perspective view of the support body of the turnable lock illustrating the cavity for receiving the turnable element and a distal end of the securing element or latch.

The rear side of the support body 192 is illustrated in FIG. 13. The support body 192 includes a recess 204 which is shaped to receive a part of the turnable element 194. When inserted into the recess 204, the forwardly facing knob 196 projects through an opening 206 of the recess 204 so that it is accessible, but a step or ledge 208 between the forwardly facing knob 196 and the base 198 prevents the turnable element 194 from passing through the opening 206 of the recess 204 entirely and keeps the rearwardly position base 198 in the recess 204 of the support body 192. There is also an angular track 207 with stops about the opening 206 which will receive and engage the radially extending tab 203 to establish a range of rotational motion of the turnable element 194 within the support body 192. Laterally outward of where the turnable element 194 is insertable in the recess 204, the recess 204 has a rectangular form 210 sized for the reception of the distal end 180 of the latch 162 when the drawer 104 is closed. The support body 192 of the turnable lock 136 also includes a pair of sleeved recesses 209 which can be used to laterally slide the support body 192 onto the front face 120 of the drawer 104 after the turnable element 194 has been received in the support body 192. Once slid on, the turnable element 194 is fixed in axial position with respect to the support body 192 as it is captured between the front face 120 of the drawer 104 and the support body 192, but is still turnable relative thereto in the angular range established by engagement of the tab 203 with the track 207.

Figure 15:
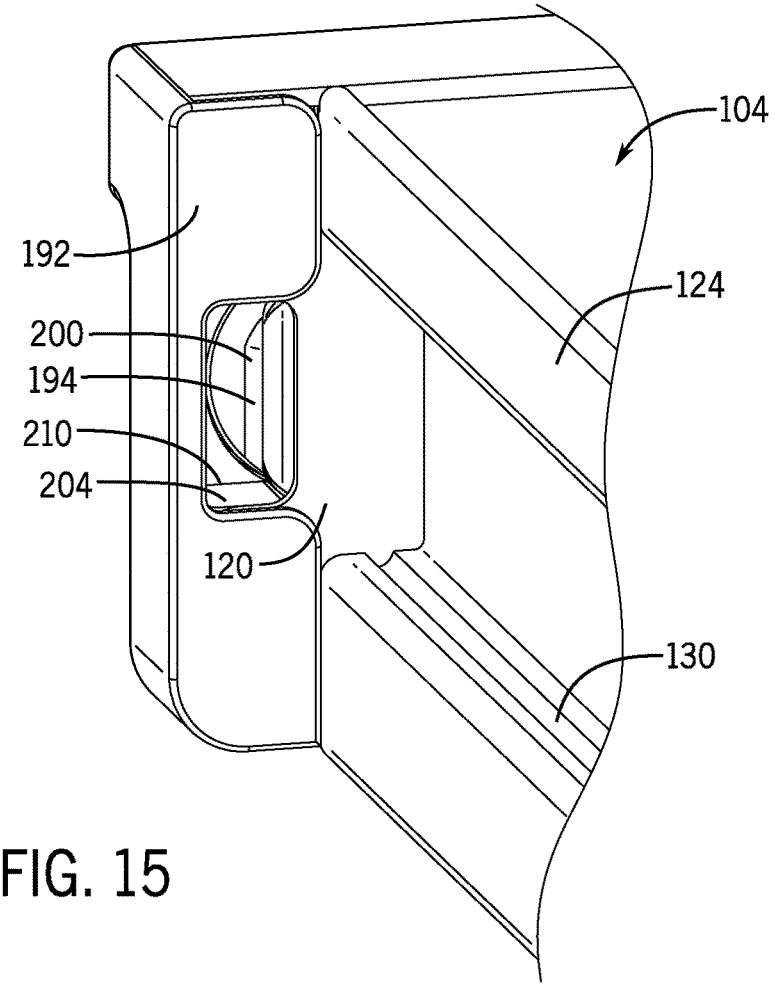
FIG. 15 is a rear side perspective view of the front of a drawer with the turnable lock installed illustrating the receiving cavity for receiving the distal end of the securing element or latch of the securable guide.

Ultimately, once assembled, the turnable lock 132 has a cavity 210 viewable from the backside of the front face 120 of the drawer 104 as best illustrated in FIG. 15. When the drawer 104 is installed in the frame 102 and moved to the closed position in which the drawer 104 is fully received in the frame 102, then the distal end 180 of the securing element 156/latch 162 is received in this cavity 210 if the turnable element 194 is rotationally positioned such that the clearance cutout 200 angularly aligns with the cavity 210. This reception is illustrated in the cross-sectional view of FIG. 16.

Figure 16:
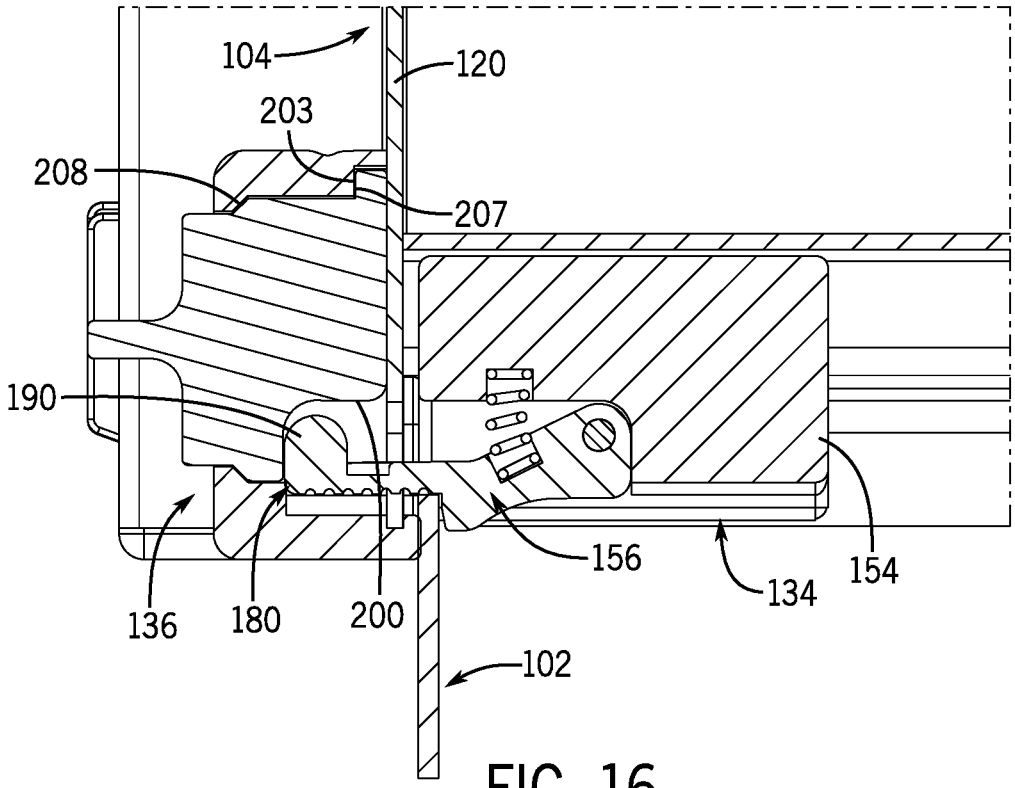
FIGS. 16 and 17 are top-down cross-sectional views of drawer assembly with the drawer and securable guides installed in the frame, with the drawer closed, and with the turnable lock in the unsecured and secured positions, respectively.
Figure 17:
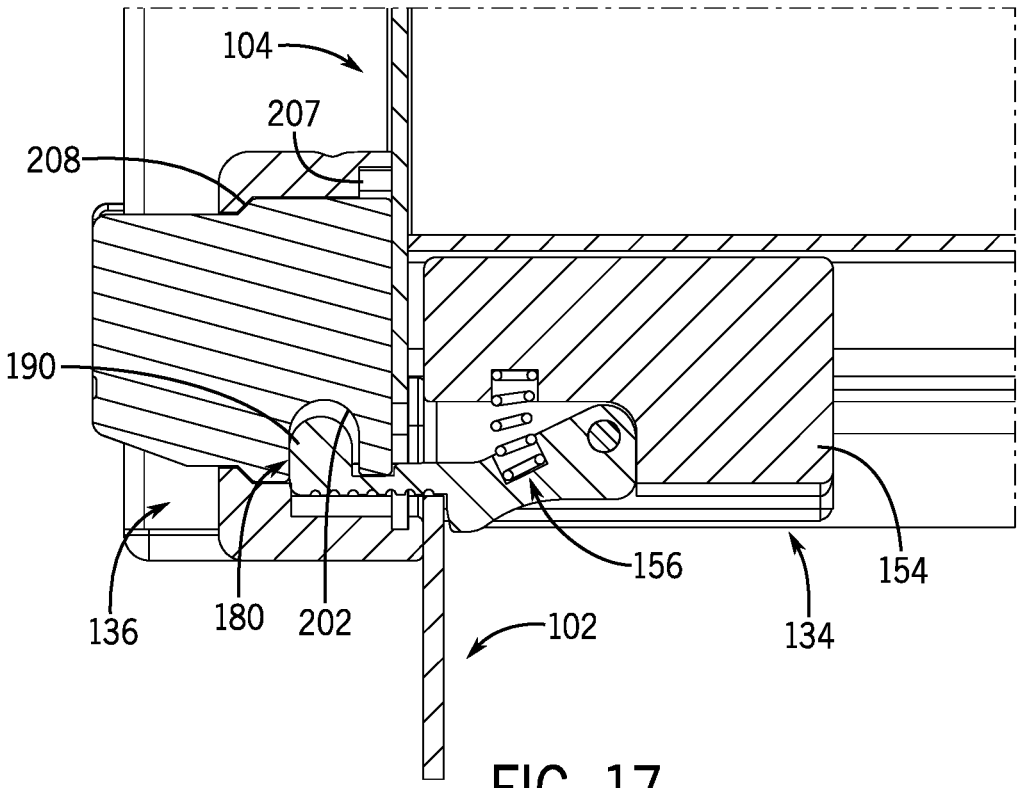

The use of the turnable lock 136 is also illustrated between FIGS. 16 and 17.

As noted above, FIG. 16 illustrates the turnable lock 132 in a configuration in which the clearance cutout 200 aligns with the cavity 210, such that the distal end 180 with the inwardly-extending ridge 190 is received therein. When the ridge 190 is fully received in the cavity 210 when the drawer 104 is fully closed, the ridge 190 is in the same axial position as the slot 202 on the turnable element 194.

With the drawer 104 closed, the turnable element 194 can then be rotated to the position illustrated in FIG. 17 such that the slot 202 is rotated into engagement with the inwardly extending ridge 190 on the latch 162. This creates a secured engagement between the drawer 104 (via the turnable locks 132 and its connection to the front face 120) and the corresponding securable guide 134 (which is connected to the frame 102) that prevents the drawer 104 from being pulled out of the frame 102. It is contemplated that in this position, a separate locking element (e.g. a padlock or other locking feature including those both external to the drawer assembly or part thereof) could potentially be secured to the turnable lock to prevent its rotation out of this secured position. To permit the drawer 104 to be reopened, the turnable element 194 is turned back to the position illustrated in FIG. 16 in which the clearance cutout 200 is aligned with the distal end 180 if the latch 162 and the drawer 104 can be pulled open (thereby withdrawing the turnable lock 136 from the securing element 156/latch 162 without interference between the two).

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto.

What is claimed is:

1. A drawer assembly comprising:

a frame having one or more drawer-receiving spaces therein which are positioned between lateral sides of the frame; and one or more drawers in which each drawer is received in a respective one or more of the drawer-receiving spaces, each drawer including:

a pair of guide-receiving tracks in which each guide-receiving track is positioned on a respective lateral side of the drawer; and a pair of securable guides with each securable guide being received in a respective guide-receiving track, each securable guide including one or more bearing surfaces in engagement with the respective guide-receiving track to permit linear sliding translation of the drawer relative to the securable guide, wherein each securable guide further includes a securing element having an installed position in which the securing element engages the lateral sides of the frame to attach and fix the securable guide in a stationary position relative to the frame in which the drawer is moveable between a fully opened position and fully closed position relative to the frame while the securable guide remains fixed in the stationary position and wherein the securing element is movable away from the installed position to allow the securable guide to be removed from the stationary position so the drawer is moveable beyond the fully opened position for removal of the respective drawer from the frame.

2. The drawer assembly of claim 1, wherein the securing element is biased towards the installed position by a biasing force and the biasing force is capable of being temporarily overcome to move the securing element away from the installed position during installation or removal of the drawer from the drawer-receiving space.

3. The drawer assembly of claim 1, wherein the securing element of the securable guide is a latch which is pivotable laterally inward and outward relative to a body portion of the securable guide with the body portion providing the one or more bearing surfaces.

4. The drawer assembly of claim 3, wherein a pivotal axis of the latch is perpendicular to a direction of linear sliding translation of the drawer relative to the securable guide.

5. The drawer assembly of claim 3, wherein the latch includes a projection stop and the frame includes a fin and wherein, when the latch is pivoted outwardly, the projection stop engages the fin to fixedly secure the latch to the frame and, when the latch is pivoted inwardly, the latch is disengaged from the frame.

6. The drawer assembly of claim 3, wherein the drawer further includes a turnable lock on a front face thereof that is, in the fully closed position of the drawer within the frame and with the securable guide in the installed position, rotatable between a secured position in which the turnable lock engages the latch to secure the drawer in the fully closed position relative to the frame and an unsecured position in which the turnable lock disengages the latch to permit the drawer to be slid to the fully opened position relative to the frame.

7. The drawer assembly of claim 6, wherein the latch further includes an inwardly-extending ridge on the distal end thereof relative to the pivotal axis and the turnable lock includes an engagement slot and wherein, in the secured position, the engagement slot of the turnable lock engages the inwardly-extending ridge on the distal end of the latch.

8. The drawer assembly of claim 6, wherein the turnable lock has a rotational axis that is parallel to a direction of linear sliding translation of the drawer relative to the securable guide.

9. The drawer assembly of claim 1, wherein the frame includes a pair of guide-receiving tracks on lateral sides of the frame.

10. The drawer assembly of claim 9, wherein the drawer further comprises a pair of fixed guides separate from the pair of securable guides in which the pair of fixed guides are fixed to the drawer rearwardly of the pair of securable guides and wherein each of the pair of fixed guides are in sliding engagement with a corresponding one of the pair of the guide-receiving tracks on lateral sides of the frame.

11. The drawer assembly of claim 1, wherein the one or more drawer-receiving spaces is a plurality of drawer-receiving spaces and wherein at least one of the one or more drawers is removable from one or more of the drawer-receiving spaces and installable into one or more drawer-receiving spaces that are vacant.

12. The drawer assembly of claim 11, wherein the one or more drawers include a plurality of drawers.

13. The drawer assembly of claim 12, wherein at least some of the drawers are a different height than others of the drawers.

14. The drawer assembly of claim 12, wherein at least some of the drawers have a height that is an integer multiple of another one of the drawers and thereby occupy multiple adjacent drawer-receiving spaces of the frame.

15. The drawer assembly of claim 1, wherein, when the securing elements of the pair of securable guides are moved away from the installed position, the respective drawer is removable from its respective one or more drawer-receiving spaces by linear sliding translation alone without tipping or rotating the drawer relative to the frame.

16. A method of placing a drawer in the drawer assembly of claim 1, the method comprising:

inserting the drawer in the frame having one or more drawer-receiving spaces therein which are positioned between lateral sides of the frame, wherein the drawer has the pair of guide-receiving tracks on respective lateral sides of the drawer and the pair of securable guides with each securable guide being received in the respective guide-receiving track and including one or more bearing surfaces in engagement with the respective guide-receiving track to permit linear sliding translation of the drawer relative to the securable guide; and moving the securing element on each of the respective securable guides to the installed position in which the securing element engages the lateral sides of the frame to attach and fix the securable guide in position relative to the frame and position the drawer in one or more of the drawer-receiving spaces.

17. The method of claim 16, wherein the securing element on each of the respective securable guides are initially in the installed position prior to the insertion step and, during the insertion step, the securing elements are temporarily moved away from the installed position before reassuming the installed position at the step of moving the securing element on each of the respective securable guides to the installed position.

18. The method of claim 16, further comprising the steps of:

moving the securing element on each of the respective securable guides away from the installed position;

removing the drawer from one or more drawer-receiving spaces in which the drawer was located; and inserting the drawer into another drawer-receiving space.

19. The method of claim 16, wherein the drawer further comprises a turnable lock on a front face of the drawer and the method further comprising the step of, when the drawer is in the fully closed position within the frame, rotating the turnable lock to engage the turnable lock with the securing element on the corresponding securable guide and, by such engagement, inhibiting the drawer from being opened.

20. A drawer comprising:

a pair of guide-receiving tracks in which each guide-receiving track is positioned on a respective lateral side of the drawer; and a pair of securable guides with each securable guide being received in a respective guide-receiving track, each securable guide including one or more bearing surfaces in engagement with the respective guide-receiving track to permit linear sliding translation of the drawer relative to the securable guide, wherein each securable guide further includes a securing element having an installed position to selectively secure the drawer by the pair of securable guides to a structure with one or more drawer-receiving spaces and wherein the securable guide is movable away from the installed position for insertion or removal of the respective securable guide of the drawer from the frame;

wherein the securing element of the securable guide is a latch which is pivotable laterally inward and outward relative to a body portion of the securable guide with the body portion providing the one or more bearing surfaces.

21. The drawer of claim 20, wherein the drawer further includes a turnable lock on a front face thereof that is, with the corresponding securable guide positioned proximate the front face and with the securable guide in the installed position, rotatable between a secured position in which the turnable lock engages the latch to secure the front face of the drawer relative to the securable guide such that the front face of the drawer is not movable away from the securable guide and an unsecured position in which the turnable lock disengages the latch to permit the securable guide to be slid away from the front face of the drawer.

* * * * *